US005846681A

United States Patent [19]

Yu et al.

[11] Patent Number: 5,846,681

[45] Date of Patent: Dec. 8, 1998

[54] MULTILAYER IMAGING MEMBER HAVING IMPROVED SUBSTRATE

[75] Inventors: Robert C. U. Yu, Webster; Richard L. Post, Penfield, both of N.Y.

[73] Assignee: Xerox Corporation, Stamford, Conn.

[21] Appl. No.: 953,619

[22] Filed: Sep. 30, 1992

[51] Int. Cl.[6] ..... G03G 5/00

[52] U.S. Cl. ..... 430/96; 430/58

[58] Field of Search ..... 430/96, 58

[56] References Cited

U.S. PATENT DOCUMENTS

| | | | |
|---|---|---|---|
| 3,121,006 | 2/1964 | Middleton et al. | 430/97 |
| 3,357,989 | 12/1967 | Byrne et al. | 40/78 |
| 3,442,781 | 5/1969 | Weinberger | 430/77 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,415,639 | 11/1983 | Horgan | 430/58 |
| 4,584,253 | 4/1986 | Lin et al. | 430/60 |
| 4,664,995 | 5/1987 | Horgan | 430/59 |
| 4,983,481 | 1/1991 | Yu | 430/59 |
| 4,988,597 | 1/1991 | Spiewak et al. | 430/62 |
| 5,213,929 | 5/1993 | Takano et al. | 430/58 |
| 5,229,239 | 7/1993 | Yu | 430/67 |

OTHER PUBLICATIONS

*"Principles of Polymer Systems"*, Ferdinand Rodriguez pp. 285–286 (1982).

*Textbook of Polymer Science,* Fred Billmeyer, p. 144 (1984).

*Primary Examiner*—M. Nuzzolillo
*Assistant Examiner*—L. S. Werner
*Attorney, Agent, or Firm*—Oliff & Berridge, PLC

[57] ABSTRACT

An imaging member has a substrate of a polymer insoluble in solvent for the charge transport layer, a Tg of at least 90° C. and a linear thermal contraction coefficient substantially identical to the linear thermal contraction coefficient of a charge transport layer.

18 Claims, 1 Drawing Sheet

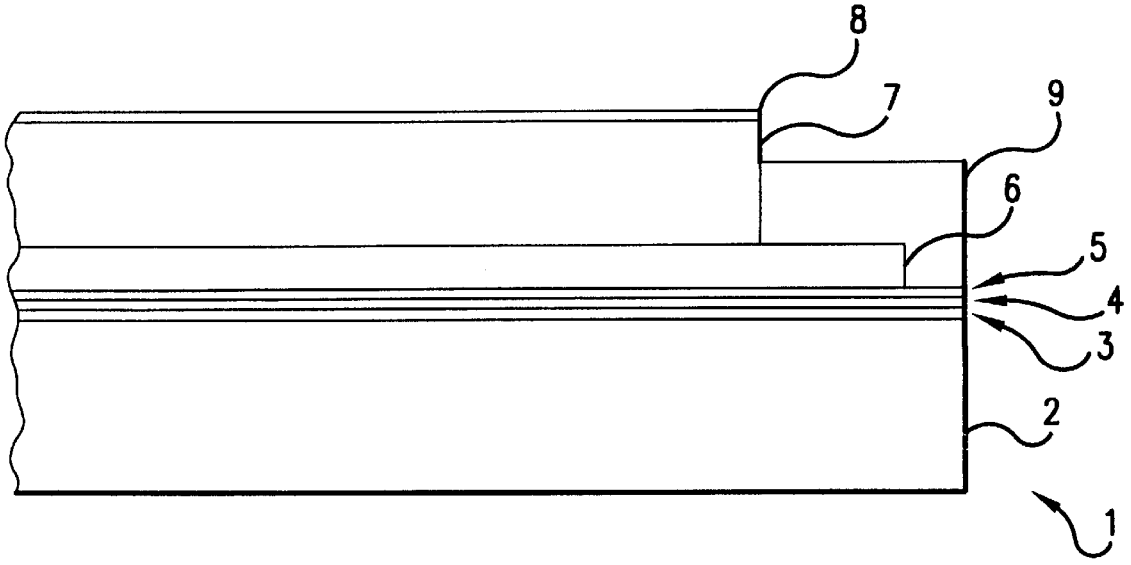
8
7
9
6
5
4
3
2
1

MULTILAYER IMAGING MEMBER HAVING IMPROVED SUBSTRATE

BACKGROUND OF THE INVENTION

This invention relates in general to electrostatography and, in particular, to electrophotoconductive imaging members having multiple layers.

In electrophotography, an electrophotographic plate, drum, belt or the like (imaging member) containing a photoconductive insulating layer on a conductive layer is imaged by first uniformly electrostatically charging its surface. The imaging member is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a support such as paper. This imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive compound dispersed in an electrically insulating organic resin binder. A layered photoreceptor having separate photogenerating and charge transport layers is disclosed in U.S. Pat. No. 4,265,990. The photogenerating layer is capable of photogenerating charge and injecting the photogenerated charge into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements, including narrow operating limits, on photoreceptors.

The numerous layers found in many modern photoconductive imaging members must be highly flexible, adhere well to adjacent layers and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl backing layer and an overcoating layer.

When one or more photoconductive layers are applied to a flexible supporting substrate the resulting photoconductive member tends to curl. Curling is undesirable for a number of reasons. During the electrophotographic imaging process, curling may result in non-uniform distances from a charging device. Non-uniform distances produce non-uniform charging, resulting in variations in high background deposits during development of the electrostatic latent image. Further, a curled imaging member requires considerable tension to flatten against a supporting member. Where the support comprises a large flat area for full frame flash exposure, the imaging member may tear while flattening.

Further, belts from flattened, curled members are more likely to incur stress induced cracks during cycling. These cracks print out on the final electrophotographic copy. Member belts subjected to high tension to remove curling also are more vulnerable to develop premature mechanical failure due to belt creep and dynamic fatigue if used in belt module designs utilizing small roller sizes (e.g. 19 mm or smaller).

An anti-curl coating may be applied to the side of the supporting substrate opposite the photoconductive layer to counteract the tendency to curl. However, application of such a coating requires an additional operational step and additional materials thereby reducing production throughput and increasing cost. Further, anti-curl coatings have not been wholly satisfactory. The anti-curl coating may wear off after extended belt machine functions. The anti-curl coating may also delaminate and separate during functioning under service conditions of high temperature and high humidity rendering the photoconductive imaging member unacceptable for forming quality images.

Moreover, an anti-curl coating reduces transparency. Hence, an anti-curl coating reduces the performance of electrophotographic imaging systems requiring rear exposure to activating electromagnetic radiation Although the reduction in transparency may in some cases be compensated by increasing the intensity of the electromagnetic radiation, such increase is generally undesirable due to the amount of heat generated as well as the greater costs necessary to achieve the higher intensity.

U.S. Pat. No. 4,983,481 relates to an imaging member that addresses curl problems by providing a substrate layer with a linear thermal contraction coefficient substantially identical to the linear thermal contraction coefficient of the charge transport layer. Generally, the supporting layer and the charge transport layer described therein have a difference in linear thermal contraction coefficient of between about $-2\times10^{-5}/°$ C. and about $2\times10^{-5}/°$ C. U.S. Pat. No. 4,983,481 discloses several substrate materials suitable for matching the thermal contraction of the charge transport layer to eliminate internal stress and produce imaging member flatness. Generally mentioned as suitable is any flexible web or sheet having a linear thermal contraction coefficient substantially identical to the thermal contraction coefficient of the charge transport layer including a thermoplastic film forming polymer alone or a thermoplastic film forming polymer containing a dispersion of other materials such as conductive particles of metal, carbon black and the like. Particularly described flexible support substrates comprising film forming polymers include insulating non-conducting materials comprising various resins such as polyethersulfone resins, polycarbonate resins, polyvinyl fluoride resins, polystyrene resins and amorphous polyethylene terephthalate. Preferred substrates are polyethersulfone (Stabar S-100, available from ICI), polyvinyl fluoride (Tedlar, available from E. I. duPont de Nemours & Company), bisphenol-A polycarbonate (Makrofol, available from Mobay Chemical Company) and amorphous polyethylene terephthalate (Melinar, available from ICI Americas, Inc.)

Many of these substrate materials provide satisfactory linear thermal contraction coefficients for matching the linear thermal contraction coefficient of a particular applied charge transport layer. However, these materials are otherwise unsatisfactory because they fail during the imaging member manufacturing process or in service under machine operating conditions. For example, substrate materials may develop cracks during solution coating of other layers in the imaging member manufacturing process. Polyethersulfone resins such as Stabar S-100 and polycarbonate resins such as Makrofol are examples of substrate materials particularly susceptible to cracking.

Further, some imaging members characterized by substrates having a linear thermal contraction coefficient substantially identical to the linear thermal contraction coefficient of the charge transport layer fail under conditions of applied tension at elevated temperatures. In manufacturing, a web of imaging member is subjected to a tension during the production coating process and to an elevated temperature of about 115° C. During machine operation, the belt is constantly subjected to a tension and to a machine cavity temperature of about 50° C. Under these conditions, some imaging members having substrates of matched linear thermal contraction coefficient but poor resistance to heat, yield and develop permanent dimensional deformation. These substrate materials include polyvinyl fluoride resins such as Tedlar and amorphous polyterephthalate resins such as Melinar.

Thus, the curl-free characteristics of electrophotographic imaging members comprising known substrate materials of matched linear thermal contraction have been unsatisfactory.

SUMMARY OF THE INVENTION

In accordance with this invention, an electrophotographic imaging member comprises a substrate and a charge transport layer applied by solvent coating. The substrate comprises a polymer substantially insoluble in the solvent for the charge transport layer, has a glass transition temperature ($T_g$) of at least 90° C. and a linear thermal contraction coefficient substantially identical to the linear thermal contraction coefficient of the charge transport layer. The imaging member is resistant to the development of cracks and to creep or dimensional deformation during manufacturing and machine operation.

Further in accordance with the invention, a process for preparing an electrophotographic imaging member comprises selecting solvent and materials for a charge transport layer, determining a linear thermal contraction coefficient of the charge transport layer, providing a substrate comprised of a polymer which has a $T_g$ of at least 90° C. and a linear thermal contraction coefficient substantially identical to the linear thermal contraction coefficient of the charge transport layer and, forming an electrophotographic imaging member comprised of the substrate and the charge transport layer.

The step of providing a substrate may comprise providing a substrate of a polymer substantially insoluble in the solvent of the charge transport layer. An otherwise non-suitable polymer soluble in, for example methylene chloride, may be fabricated into a substrate and irradiated with gamma ray irradiation. The substrate polymer is cross linked and rendered insoluble.

BRIEF DESCRIPTION OF THE DRAWING

The FIGURE is a cross-sectional view of a multilayer photoreceptor of the invention.

DESCRIPTION OF PREFERRED EMBODIMENTS

Any underlying flexible support layer of any suitable polymer may be used so long as the polymer is substantially insoluble in the solvent for the charge transport layer and is characterized by a $T_g$ of at least 90° C., preferably of at least 110° C., and a linear thermal contraction coefficient substantially identical to the linear thermal contraction coefficient of the charge transport layer. In preferred embodiments, the supporting layer and the charge transport layer may have a difference in linear thermal contraction coefficient of between about $-2\times10^{-5}$/° C. and about $2\times10^{-5}$/° C. Imaging members characterized by support substrates of the present invention do not readily fail due to cracking during manufacture.

Further, support substrates of the present invention are satisfactory under conditions of tension stress and elevated temperature encountered during either imaging member manufacturing or imaging belt machine functioning. Particularly, the imaging members resist creep and do not develop permanent dimensional deformation. The imaging member belts do not curl even after extended use.

An exemplary electrophotographic imaging member of the present invention is shown in the FIGURE. The imaging member 1 is provided with a supporting substrate 2, an electrically conductive ground plane 3, a charge blocking layer 4, an adhesive layer 5, a charge generating layer 6, a charge transport layer 7 and an optional overcoating layer 8.

In the above-described device, a ground strip 9 is preferably provided adjacent the charge transport layer 7 at an outer edge of the imaging member. See U.S. Pat. No. 4,664,995. The ground strip 9 is coated adjacent to the charge transport layer 7 so as to provide grounding contact with a ground device (not shown) during electrophotographic imaging processes.

Since this imaging member does not curl, it does not require an anti-curl layer commonly employed on one side of a support substrate of an electrophotographic imaging member.

A description of the layers of the exemplary electrophotographic imaging member shown in the FIGURE follows.

The Supporting Substrate

The supporting substrate 2 may be opaque or substantially transparent and may comprise any suitable polymer substantially insoluble in the solvent for the charge transport layer and having a $T_g$ of at least 90° C. and a linear thermal contraction coefficient substantially identical to the linear thermal contraction coefficient of the charge transport layer. A combination of polymers, each insoluble in the charge transport layer solvent and each having $T_g$ of at least 90° C., is suitable so long as the resulting substrate has thermal contraction coefficient match with the charge transport layer. Substrates of polymers in multilayered configurations or of a blend of components are satisfactory so long as the $T_g$ of the resulting substrate is at least 90° C. The polymer may be a thermoplastic polymer or a thermoset polymer. The substrate may comprise electrically non-conductive or conductive material. In the instance the polymer is non-conductive, it may be provided with an electrically conductive surface and/or be loaded with conductive particles.

Suitable polymers are those which are insoluble in the solvent selected for applying the charge transport layer. Typical solvents for the charge transport layer include tetrahydrofuran, cyclohexanone, 1,1,1-trichloroethane, 1,1,2-trichloroethane, trichloroethylene, toluene and methylene chloride.

If the solvent for application of the charge transport layer is methylene chloride, suitable polymers include polyamide/nylons such as Zytel 330 and Zytel ST-901 from E. I. du Pont, polyamide imides such as Torlon 4203L from Amoco Performance Products, Inc., polyether imides such as Ultem 1000 from General Electric Co., polyesters such as Bexloy K550 and Bexloy APC from du Pont and Valox 855 from General Electric, polycarbonate/polybutylene terephthalate (PBT) alloys such as Xenoy 2000 from General Electric, polyketones such as Kadel E 1000 from Amoco, polyphthalamides such as Amodel A-1145HS from Amoco, polyester liquid crystals such as Xydar G-330 from Amoco, phenolic polymers such as Fiberite FM-32780 from ICI/Fiberite and Plenco 06582 from Plenco Plastics, polyureas such as Spectrim from Dow Chemical Co., and Diallyl Phthalates such Rogers RX1-501AN, Rogers RX1-503 and Rogers RX1-510N from Rogers Corp. Suitable polymers and their thermal properties are listed in Table I as follows:

TABLE I

| POLYMER | TRADE NAME | COEFFICIENT OF THERMAL CONTRACTION | Tg (°C.) |
|---|---|---|---|
| Polyamide/Nylon | Zytel 330 | $6.2 \times 10^{-5}$/°C. | 120 |
| Polyamide/Nylon | Zytel ST-901 | $7.3 \times 10^{-5}$/°C. | 105 |
| Polyamide imide | Torlon 4203L | $4.0 \times 10^{-5}$/°C. | 275 |
| Polyether imide | Ultem 1000 | $5.6 \times 10^{-5}$/°C. | 216 |
| Polyester | Bexloy K550 | $5.7 \times 10^{-5}$/°C. | 108 |
| Polyester | Bexloy APC | $6.7 \times 10^{-5}$/°C. | 100 |
| Polyester | Valox 855 | $6.1 \times 10^{-5}$/°C. | 102 |
| Polycarbonate/PBT Alloy | Xenoy 2000 | $5.9 \times 10^{-5}$/°C. | 122 |
| Polyketone | Kadel E1000 | $7.2 \times 10^{-5}$/°C. | 140 |
| Polyphthalamide | Amodel A-1145HS | $5.3 \times 10^{-5}$/°C. | 135 |
| Polyester Liquid Crystal | Xydar G-330 | $7.2 \times 10^{-5}$/°C. | 240 |
| Phenolic | Fiberite FM-32780 | $4.8 \times 110^{-5}$/°C. | 220 |
| Phenolic | Plenco 06582 | $4.5 \times 10^{-5}$/°C. | 210 |
| Polyurea | Spectrim | $6.2 \times 10^{-5}$/°C. | 120 |
| Dially Phthalate | Rogers RX1-501AN | $5.8 \times 10^{-5}$/°C. | 135 |
| Dially Phthalate | Rogers RX1-503 | $6.4 \times 10^{-5}$/°C. | 125 |
| Dially Phthalate | Rogers RX1-510N | $5.4 \times 10^{-5}$/°C. | 130 |

In another aspect of the present invention, polymers which otherwise would be unsuitable because of objectionable solubility in the solvent used to apply the charge transport layer, may be fabricated into a substrate and then subjected to gamma ray irradiation. The application of gamma ray irradiation cross links the polymer to provide an insoluble form. For example, listed in the following Table II are polymers which are soluble in methylene chloride. However, these polymers are suitable for use as substrates with methylene chloride applied charge transport layers after being subjected to gamma ray irradiation. These polymers include polysulfones such as Ultrason from BASF, Lubricon from LNP Engineering and Udel and Mindel from Amoco, polyaryl sulfones such as Radel from Amoco, polyacrylates such as Radel from Amoco, acrylic polymers such as Diakon from ICI Americas, Inc., polyvinyl chlorides such as Geon from B. F. Goodrich, polyphenylene ethers such as Prevex from General Electric, polyphenylene oxides such Noryl from General Electric, acrylonitrile butadiene styrene copolymers such as Cycolac from General Electric and Rovel from Dow Chemical, bisphenol A polycarbonates such as Lexan from General Electric, and Makrolon from Mobay Chemicals, polyether sulfones such as Vitrex from ICI Americas, Inc., polystyrenes such as Lustrex from Monsanto, and acrylonitriles such as Lustran from Monsanto. Polymers which may be fabricated into substrates and then cross linked by gamma ray irradiation for use with a charge transport layer applied with a methylene chloride solvent are listed in the following Table II.

TABLE II

| POLYMER | TRADE NAME | COEFFICIENT OF THERMAL CONTRACTION |
|---|---|---|
| Polysulfone | Ultrason | $6.1 \times 10^{-5}$/°C. |
| Polysulfone | Lubricomp | $6.0 \times 10^{-5}$/°C. |
| Polysulfone | Udel | $5.6 \times 10^{-5}$/°C. |
| Polysulfone | Mindel | $6.4 \times 10^{-5}$/°C. |
| Polyarylsulfone | Radel | $5.1 \times 10^{-5}$/°C. |
| Polyarylate | Ardel | $7.2 \times 10^{-5}$/°C. |
| Acrylic | Diakon | $6.3 \times 10^{-5}$/°C. |
| Polyvinyl Chloride | Geon | $6.0 \times 10^{-5}$/°C. |
| Polyphenylene Ether | Prevex | $6.5 \times 10^{-5}$/°C. |
| Polyphenylene Oxide | Noryl | $6.8 \times 10^{-5}$/°C. |
| Acrylonitrile Butadiene Styrene | Cycolac | $6.4 \times 10^{-5}$/°C. |
| Acrylonitrile Butadiene Styrene | Rovel | $6.8 \times 10^{-5}$/°C. |
| Bisphenol A Polycarbonate | Lexan | $6.5 \times 10^{-5}$/°C. |
| Bisphenol A Polycarbonate | Makrolon | $6.5 \times 10^{-5}$/°C. |
| Polyether Sulfone | Vitrex | $6.0 \times 10^{-5}$/°C. |
| Polystyrene | Lustrex | $6.2 \times 10^{-5}$/°C. |
| Acrylonitrile | Lustran | $6.8 \times 10^{-5}$/°C. |

The supporting substrate layer is highly flexible and may have any number of different configurations such as, for example, a sheet, a scroll, an endless flexible belt, and the like. Preferably, the substrate is in the form of an endless flexible belt and comprises a polyamide/nylon polymer. This substrate material is preferred because it has a thermal contraction (or expansion) coefficient that is closely matched with that of preferred charge transport materials.

Satisfactory results may be achieved when the difference in linear thermal contraction coefficient between the substrate layer and the charge transport layer is minimal, preferably between about $-2\times10^{-5}$/°C. and about $2\times10^{-5}$/° C. Preferably, the difference in linear thermal contraction coefficient between the substrate layer and the charge transport layer is between about $-1\times10^{-5}$/° C. and about $1\times10^{-5}$° C. Optimum results are achieved when the difference in linear thermal contraction coefficient between the substrate layer and the charge transport layer is between about $-0.5\times10^{-5}$/°C. and about $0.5\times10^{-5}$/°C. The linear thermal contraction coefficient in each case is determined at a temperature in the range of 0° C. and the Tg of the substrate.

The linear thermal contraction coefficient characteristics may be determined for the substrate and charge transport layers by measurements taken in two directions along the plane of the layers, the two directions being about 90° C. apart. The linear thermal contraction (or expansion) coefficient may be determined by well known ASTM techniques, including those described, for example, in "Standard Test Method for Coefficient of Cubicle. Thermal Expansion of Plastics, ASTM Designation: D 864-52" (reapproved 1978); "Standard Test Method for Linear Thermal Expansion of Solid Materials with a Vitreous Silica Dilatometer", ASTM Designation: E 228-85; and "Standard Test of Coefficient of Linear Thermal Expansion of Plastics", ASTM Designation: D 696-79.

The linear thermal contraction or expansion coefficient for plastics involves a reversible thermal change in length per unit length resulting from a temperature change. Measurements are taken at temperatures below the glass transition temperatures of the film forming polymers and may be made with any suitable device such as a conventional dilatometer. The linear thermal contraction coefficient varies significantly when the glass transition temperature is exceeded. Therefore, the linear thermal contraction coefficient value for the purpose of this invention is measured at a temperature below the glass transition temperature. A typical procedure for measuring the linear thermal contraction coefficient is ASTM D 696-79 Standard Test Method for Coefficient of Linear Thermal Expansion of Plastics. As is well known in the art, the linear thermal contraction coefficient of a material is the same as the linear thermal expansion coefficient of that material. For purposes of testing to determine the linear thermal contraction coefficient of a given type of material, each layer is formed and tested as an independent layer.

Typical charge transport layers have thermal contraction coefficients in the range of about $1.0\times10^{-5}$/°C. and about $13\times10^{-5}$/°C. Some preferred charge transport layers have thermal contraction coefficients in the range of about $5.6\times10^{-5}$/°C. and about $7.5\times10^{-5}$/°C. Hence, preferably, the polymeric substrate thermal contraction coefficient is in the range of about $5.6\times10^{-5}$/°C. and about $7.5\times10^{-5}$/°C.

Generally, the substrate is chosen to provide a match to the linear thermal contraction coefficient of the charge transfer layer. First, materials and parameters are selected for the charge transport layer. The linear thermal contraction coefficient of the charge transport layer is determined and a substrate is selected comprised of a polymer substantially insoluble in the solvent for the charge transport layer and having a $T_g$ of at least 90° C. and a linear thermal contraction coefficient substantially identical to the linear thermal contraction coefficient of the charge transport layer. The process for preparing the electrophotographic imaging member comprises selecting materials and parameters for the charge transport layer, determining the thermal contraction coefficient of the charge transport layer, selecting the substrate to meet the above requirements of the invention, and forming an electrophotographic imaging member comprised of the substrate and the charge transport layer.

The film forming polymers employed in the substrate layer and in the charge transport layer should preferably be isotropic and not anisotropic. An isotropic material is defined as a material having dimensional physical and mechanical properties that are identical in all directions. Isotropic materials do not distort or alter in shape when heated or cooled. Whereas anisotropic materials do distort when heated or cooled. Isotropic materials may be tested by either cubical or linear thermal expansion coefficient tests. An anisotropic material is defined as a material having dimensional physical and mechanical properties that are not identical in all directions. An example of an anisotropic material is biaxially oriented polyethylene terephthalate (e.g., Mylar, available from E. I. du Pont de Nemours & Co., Melinex from ICI Americas, Inc. and Hostaphan from Hoescht Celenese Corporation.)

The substrate may be formed by any process suitable for forming the required shape, e.g. web, sheet or belt. Conductive particles may be loaded during the polymerization of the substrate polymer or may be compounded or dispersed into the polymer matrix of the substrate, or may be coated onto the substrate as a separate film or layer.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, 200 micrometers, or of minimum thickness, for example 50 micrometers, provided there are no adverse effects on the final photoconductive device. The surface of the substrate layer is preferably cleaned prior to coating to promote greater adhesion of the deposited conductive coating. Cleaning may be effected by exposing the surface of the substrate layer to plasma discharge, ion bombardment and the like.

The Electrically Conductive Ground Plane

The electrically conductive ground plane 3 (if needed) may be an electrically conductive layer such as a metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures and alloys thereof. The conductive layer 3 may vary in thickness over substantially wide ranges depending on the optical transparency and flexibility desired for the electrophotoconductive member. Accordingly, for a flexible photoresponsive imaging device, the thickness of the conductive layer 3 is preferably between about 20 Angstroms to about 750 Angstroms, and more preferably from about 50 Angstroms to about 200 Angstroms for an optimum combination of electrical conductivity, flexibility and light transmission.

Regardless of the technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Generally, for rear erase exposure, a conductive layer light transparency of at least about 15 percent is desirable. The conductive layer need not be limited to metals. Other examples of conductive layers are combinations of materials such as conductive indium tin oxide as a transparent layer for light having a wavelength between about 4000 Angstroms and about 9000 Angstroms or a conductive carbon black dispersed in a plastic binder as an opaque conductive layer.

The Charge Blocking Layer

After deposition of any electrically conductive ground plane layer 3, a charge blocking layer 4 may be applied. Electron blocking layers for positively charged photoreceptors allow holes from the imaging surface of the photoreceptor to migrate toward the conductive layer. For negatively-charged photoreceptors, any suitable charge blocking layer capable of forming a barrier to prevent hole injection from the conductive layer to the photoconductive layer may be utilized. The blocking layer 4 may include polymers such as polyvinylbutyral, epoxy resins, polyesters, polysiloxanes, polyamides, polyurethanes and the like; nitrogen-containing siloxanes or nitrogen-containing titanium compounds such as trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N-dimethylethylamino)-titanate, titanium-4-aminobenzene sulfonate oxyacetate, titanium 4-aminobenzoate isostearate oxyacetate, $[H_2N(CH_2)_4]CH_3Si(OCH_3)_2$ (gamma-aminobutyl methyl dimethoxy silane), $[H_2N(CH_2)_3]CH_3Si(OCH_3)_2$ (gamma-aminopropyl methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033 and 4,291,110. A preferred blocking layer 4 comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes have the general formula:

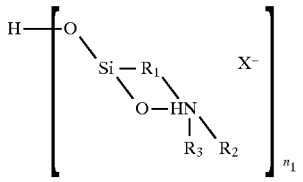

or

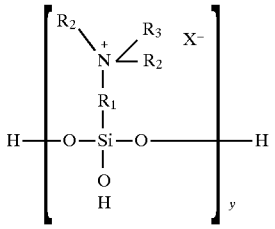

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4.

The blocking layer 4 should be continuous and have a thickness of less than about 0.5 micrometer because greater thicknesses may lead to undesirable high residual voltage. A blocking layer 4 of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for optimum electrical behavior.

The blocking layer 4 may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer 4 is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

The Optional Adhesive Layer

Intermediate layers between the blocking layer 4 and the charge generating or photogenerating layer 6 may be desired to promote adhesion. For example, an adhesive layer 5 may be employed. If such layer is utilized, preferably it has a dry thickness between about 0.01 micrometer to about 0.3 micrometer, more preferably about 0.05 to about 0.2 micrometer.

Typical adhesive layers include film-forming polymers such as polyester, du Pont 49,000 resin (available from E. I. du Pont de Nemours & Co.), Vitel PE-100 (available from Goodyear Rubber & Tire Co.), polyvinylbutyral, polyvinylpyrrolidone, polyurethane, polymethyl methacrylate, or the like. Both the du Pont 49,000 and Vitel PE-100 adhesive layers are preferred because they provide reasonable adhesion strength and produce no deleterious electrophotographic impact on the resulting imaging members.

Du Pont 49,000 is a linear saturated copolyester of four diacids and ethylene glycol having a molecular weight of about 70,000 and a glass transition temperature of 32° C. Its molecular structure is represented as $$HO-\overset{\overset{\displaystyle O}{\|}}{C}\text{-[diacid-ethylene glycol]}_n\text{-OH}$$

where n is a number which represents the degree of polymerization and gives a molecular weight of about 70,000. The ratio of diacid to ethylene glycol in the copolyester is 1:1. The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000 and a glass transition temperature of 71° C. Its molecular structure is represented as $$HO-\overset{\overset{\displaystyle O}{\|}}{C}\text{-[diacid-ethylene glycol]}_n\text{-OH}$$

where n is a number which represents the degree of polymerization and gives a molecular weight of about 50,000. The ratio of diacid to ethylene glycol in the copolyester is 1:1. The two diacids are terephthalic acid and isophthalic acid in a ratio of 3:2.

Du Pont 49,000 and Vitel PE-100 can be easily mixed to form a polymer blend. When coated one over the top of the other, they adhere to each other so strongly that they become practically inseparable. Accordingly, it is preferred to use a combination of such chemically similar compounds because of their highly miscible and highly adhesive properties with one another.

Another polyester resin adhesive is available from Goodyear Tire & Rubber Co. as Vitel PE-200. This polyester resin is a linear saturated copolyester of two diacids and two diols. The molecular structure of this linear saturated copolyester is represented by the following:

$$HO-\overset{\overset{\displaystyle O}{\|}}{C}\text{-[diacid-diol]}_n\text{-OH}$$

where the ratio of diacid to diol in the copolyester is 1:1. The diacids are terephthalic acid and isophthalic acid in a ratio of 1.2:1. The two diols are ethylene glycol and 2,2-dimethyl propane diol in a ratio of 1.33:1. The Goodyear PE-200 linear saturated copolyester contains randomly alternating monomer units of the two diacids and the two diols and has a molecular weight of about 45,000 and a $T_g$ of about 67° C.

The Charge Generating Layer

The charge generating (photogenerating) layer 6 may be applied to the adhesive layer 5 or directly to the charge blocking layer 4 if an adhesive layer is not used. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal-free phthalocyanine described in U.S. Pat. No. 3,357,989, metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments from ICI Americas, Inc. under the trade names Vat orange 1 and Vat orange 3; benzimidazole perylene; substituted 2,4-diamino-triazines such as those disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like, dispersed in a film forming polymeric binder. Also suitable are combination photogenerating layers that include a photoconductive layer to enhance or reduce the properties of the photogenerating material. Examples of this type of configuration are described in U.S. Pat. No. 4,415,639. Other suitable photogenerating materials known in the art may also be utilized, if desired.

Charge generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Any suitable polymeric film-forming binder material may be employed as the matrix in the photogenerating layer 6. Typical polymeric film-forming materials include those described in U.S. Pat. No. 3,121,006. When an adhesive layer is used, the binder polymer should dissolve in a solvent which also dissolves the upper surface of the adhesive layer and be miscible with the polymer of the adhesive layer to form a polymer blend zone. The solvent for the charge generating layer binder polymer should dissolve the polymer binder utilized in the charge generating layer and be capable of dispersing the photogenerating pigment particles present in the charge generating layer. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride.

A binder need not be present in the charge generating layer. If a binder is present, the photogenerating composition or pigment may be present in the resinous binder in various amounts. Generally, from about 5 to 90 percent by volume of the photogenerating pigment is dispersed in about 95 to 10 percent by volume of the resinous binder. Preferably from about 20 percent by volume to about 30 percent by volume of the photogenerating pigment is dispersed in about 80 percent by volume to about 70 percent by volume of the resinous binder composition. However, when trigonal selenium photogenerating pigment is used, only a low pigment concentration of about 8 percent by volume is acceptable to give good quality coating due to the coating difficulty associated with selenium loading.

The photogenerating layer 6 generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers to give equivalent pigment coverage for identical photogeneration capability. Thicknesses outside these ranges can be selected, providing the objectives of the present invention are achieved.

Any suitable and conventional technique may be utilized to mix and thereafter apply the photogenerating layer coating mixture to the previously applied layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all solvents utilized in applying the coating.

The Charge Transport Layer

The charge transport layer 7 may comprise any suitable transparent organic polymer or non-polymeric material capable of supporting the injection of photogenerated holes or electrons from the charge generating layer 6 and allowing the transport of these holes or electrons through the organic layer to selectively discharge the surface charge. Suitable materials are those which provide a layer characterized by a coefficient of thermal contraction matchable by the polymers of the substrate. To some extent, both the material making up the charge transport layer and the substrate may be controlled to provide an electrophotographic imaging member of matched coefficient of thermal contraction. Preferably, the charge transport layer is a conventional composition and the substrate is modified to achieve the match since this minimizes the need to modify electrical properties.

The charge transport layer 7 not only serves to transport holes or electrons, but also protects the charge generating layer from abrasion or chemical attack and therefore extends the operating life of the imaging member.

The charge transport layer 7 should exhibit negligible, if any, discharge when exposed to a wavelength of light useful in xerography, e.g., 4000 Angstroms to 9000 Angstroms. It is comprised of a material which supports the injection of photogenerated charge, typically holes, from the charge generating layer. The charge transport layer 7 is normally transparent to radiation in a region in which the photoconductor is to be used when exposure is effected therethrough to ensure that most of the incident radiation is utilized by the underlying charge generating layer 6. When used with a transparent substrate 2, imagewise exposure or erase may be accomplished through the substrate with all light passing through the substrate. In this case, the charge transport material need not transmit light in the wavelength region of use. The charge transport layer 7 in conjunction with the charge generating layer 6 is an insulator to the extent that an electrostatic charge placed on the charge transport layer 7 is not conducted in the absence of illumination.

The charge transport layer 7 may comprise activating compounds dispersed in normally electrically inactive polymeric materials for making these materials electrically active. These compounds may be added to polymeric materials which are incapable of supporting the injection of photogenerated charge and incapable of allowing the transport of this charge. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer 7 is preferably formed from a mixture comprising one or more compounds having the general formula:

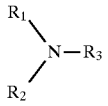

wherein $R_1$ and $R_2$ are selected from the group consisting of substituted or unsubstituted phenyl groups, naphthyl groups, and polyphenyl groups and $R_3$ is selected from the group consisting of substituted or unsubstituted aryl groups, alkyl groups having from 1 to 18 carbon atoms and cycloaliphatic groups having from 3 to 18 carbons atoms. The substituents should be free from electron-withdrawing groups such as $NO_2$ groups, CN groups, and the like.

Examples of charge-transporting aromatic amines represented by the structural formula above include triphenylmethane, bis(4-diethylamine-2-methylphenyl)-phenylmethane; 4,4'-bis(diethylamino)-2,2'-dimethyltriphenylmethane, N,N'-bis(alkyl-phenyl)-1,1'-biphenyl)-4,4'-diamine wherein the alkyl is, for example, methyl, ethyl, propyl, n-butyl, etc., N,N'-diphenyl-N,N'-bis(3-methylphenyl)-(1,1'-biphenyl)-4,4'-diamine, and the like, dispersed in an inactive resin binder.

Any suitable inactive resin binder soluble in a suitable solvent may be employed so long as the binder imparts a coefficient of thermal expansion which may be matched by a substrate as described above. Typical inactive resin binders include polycarbonate resin, polyvinylcarbazole, polyester, polyacrylate, polyether, polysulfone, and the like. Molecular weights can vary from about 20,000 to about 1,500,000. Typical suitable solvents include methylene chloride, tetrahydrofuran, toluene, trichloroethylene, 1,1,2-trichloroethane, 1,1,1-trichloroethane, and the like.

Preferred charge transport layer binder materials include, for example, polycarbonate, polystyrene, polyarylate polyether carbonate, polysilyene and the like. Particularly preferred are polycarbonate resins having a molecular weight from about 20,000 to about 120,000, more preferably from about 50,000 to about 100,000. The materials most preferred as the electrically inactive resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A. G.; a polycarbonate resin having a molecular weight of from about 20,000 to about 50,000, available as Merlon from Mobay Chemical Company; polyether carbonates; and 4,4' cyclohexylidene diphenyl polycarbonate.

Suitable solvents for dissolving the charge transport layer for solvent coating onto the charge generating layer include tetrahydrofuran, cyclohexanone, 1,1,1-trichloroethane, 1,1,2-trichloroethane, trichloroethylene and toluene. A particularly preferred solvent for the charge transport layer is methylene chloride. Methylene chloride solvent is a desirable component of the charge transport layer coating mixture for adequate dissolving of all the components and for its low boiling point. Hence, a particularly preferred embodiment of the present invention comprises the substrate of a polymer substantially insoluble in methylene chloride.

The thickness of the charge transport layer 7 may range from bout 10 micrometers to about 50 micrometers, and preferably from about 20 micrometers to about 35 micrometers. Optimum thicknesses may range from about 23 micrometers to about 31 micrometers.

The Ground Strip

The optional ground strip 9 may comprise a film-forming polymer binder and electrically conductive particles. Any suitable electrically conductive particles and any suitable binder may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip 9 depends on factors such as the conductivity of the specific conductive particles utilized.

The ground strip layer 9 may have a thickness from about 7 micrometers to about 42 micrometers, and preferably from abut 14 micrometers to about 27 micrometers.

The Overcoating Layer

The optional overcoating layer 8 may comprise organic polymers or inorganic polymers that are capable of transporting charge through the overcoat. The overcoating layer 8 may range in thickness from about 2 micrometers to about 8 micrometers, and preferably from about 3 micrometers to about 6 micrometers. An optimum range of thickness is from about 3 micrometers to about 5 micrometers.

Although described with particular reference to an electrophotographic imaging member, the present invention is applicable to any electrostatographic imaging member including ionographic imaging members.

The invention will further be illustrated in the following, non-limiting examples, it being understood that these examples are intended to be illustrative only and that the invention is not intended to be limited to the materials, conditions, process parameters and the like recited therein.

EXAMPLE I

A photoconductive imaging member is prepared by providing a 200 angstrom titanium coated polyethylene terephthalate (Melinex 442, a biaxially oriented film available from ICI Americas, Inc.) substrate having a thickness of 3 mils, a width of 9 inches and a length of 12 inches, and applying thereto, using a 0.5 mil gap Bird applicator, a solution containing 2.592 grams of 3-aminopropyltriethoxysilane, 2.62 grams distilled water, 0.784 gram acetic acid, 180 grams of 200 proof denatured alcohol and 77.3 grams heptane. This layer is allowed to dry for 5 minutes at room temperature and 10 minutes at 115° C. in a forced air oven. The resulting blocking layer has a dry thickness of 0.05 micrometer.

An adhesive interface layer is prepared by applying a wet coating over the blocking layer using a 0.5 mil gap Bird applicator. The wet coating contains 0.5 percent by weight based on the total weight of the solution of copolyester 49,000 adhesive (available from E. I. DuPont de Nemours & Co.) in a 70:30 volume ratio mixture of tetrahydrofuran/cyclohexanone. The adhesive interface layer is dried for about 5 minutes at 115° C. in the forced air oven. The resulting adhesive interface layer has a dry thickness of 0.05 micrometer.

The adhesive interface layer is thereafter coated with a photogenerating layer containing 7.5 percent by volume trigonal Selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 0.8 gram polyvinyl carbazole and 14 ml of a 1:1 volume ratio of a mixture of tetrahydrofuran and toluene into a 2 oz. amber bottle. To this solution is added 0.8 gram of trigonal selenium and 100 grams of ½ inch diameter stainless steel shot. This mixture is placed on a ball mill for 72 to 96 hours. Subsequently, 5 grams of the resulting slurry are added to a solution of 0.36 gram of polyvinyl carbazole and 0.20 gm of N,N'-diphenyl-N,N'-bis(3-methylphenyl)-1,1'-biphenyl-4,4'-diamine in 7.5 ml of a 1:1 volume ratio of tetrahydrofuran/toluene. This slurry is then placed on a shaker for 10 minutes. The resulting slurry is applied to the adhesive interface with a Bird applicator to form a layer having a wet thickness of 0.5 mil. The layer is dried at 115° C. for 5 minutes in the forced air oven to form a dry thickness photogenerating layer having a thickness of 2.0 micrometers.

This coated member, after removing from the oven, is overcoated with a charge transport layer. The charge transport layer coating solution is prepared by introducing into an amber glass bottle in a weight ratio 1:1, N,N'-diphenyl-N,N'-bis(3-methylphenyl)-1,1'-biphenyl-4,4'-diamine and Makrolon 5705, a polycarbonate resin having a molecular weight of about 100,000 and commercially available from Farbenfabricken Bayer A. G. The resulting mixture is dissolved by adding methylene chloride to the glass bottle to form a 16 weight percent solids charge transport layer solution. This solution is applied onto the photogenerator layer using a 3 mil gap Bird applicator to form a wet coating which upon drying at 115° C. in the forced air oven for 6 minutes gives a dried charge transport layer thickness of 24 micrometers. During the charge transport layer coating process, the humidity is controlled at or less than 15 percent.

The substrate has a linear thermal contraction coefficient of $1.7\times10^{-5}$/°C. and the charge transport layer has a linear thermal contraction coefficient of $6.5\times10^{-5}$/°C. While unrestrained, the opposite edges of the resulting imaging member curl simultaneously upward toward the coated side to form a 1.5 inch (3.8 cm) diameter roll. An anti-curl coating is applied to render the imaging member flat. The anti-curl coating solution is prepared in a glass bottle by dissolving 8.82 grams of polycarbonate (Makrolon 5705, available from Bayer AG) and 0.09 gram copolyester adhesion promoter (Vitel 1200, available from Goodyear Tire and Rubber Company) in 90.07 grams of methylene chloride. The glass bottle is covered tightly and placed on a roll mill for about 24 hours until total dissolution of the polycarbonate and the copolyester is achieved. The resulting anti-curl coating solution is applied to the rear surface of the support substrate (the side opposite to the imaging layers) of the photoreceptor device by hand coating using a 3 mil gap Bird applicator. The coated wet film is dried at 115° C. in a forced air oven for about 5 minutes to produce a dry, 14 micrometers thick anti-curl layer.

EXAMPLE II

The procedure of Example I is followed to prepare a photoconductive imaging member except that the biaxially oriented polyethylene terephthalate support substrate is substituted with a 4 mil polyether sulfone substrate (Stabar S100, available from ICI Americas, Inc.). The polyether sulfone substrate is soluble in methylene chloride. This polyether sulfone substrate has a linear thermal contraction coefficient of $6.0\times10^{-5}$/°C. , about equivalent to the linear thermal contraction coefficient of the coated charge transport layer. No anti-curl layer is needed and the fabricated photoconductive imaging member is flat.

EXAMPLE III

The procedure of Example I is followed to prepare a photoconductive imaging member except that the biaxially oriented polyethylene terephthalate support substrate is substituted with a 4 mil polycarbonate substrate (Makrofol E, available from ICI Americas, Inc.). The polycarbonate substrate is soluble in methylene chloride. The substrate has a linear thermal contraction coefficient of $6.5\times10^{-5}$/°C. , identical to that of the charge transport layer. The fabricated photoconductive imaging member is curl-free without an anti-curl layer.

EXAMPLE IV

The procedure of Example I is followed to prepare a photoconductive imaging member except that the biaxially oriented polyethylene terephthalate support substrate is replaced with a 4 mil polyvinyl fluoride substrate (Tedlar, available from du Pont de Nemours & Co.). The polyvinyl fluoride substrate is insoluble in methylene chloride. This substrate, has a linear thermal contraction coefficient ($7.1\times10^{-5}$/°C. ) about equivalent to that of the charge transport layer. The resulting imaging member is curl-free.

EXAMPLE V

The procedure of Example I is followed to prepare a photoconductive imaging member except that the biaxially oriented polyethylene terephthalate support substrate is replaced with a 4 mil amorphous polyethylene terephthalate substrate (Melinar, available from ICI Services, Inc.). The polyethylene terephthalate substrate is insoluble in methylene chloride. Both the substrate and the charge transport layer have the same linear thermal contraction coefficient ($6.5\times10^{-5}$/°C. ). The resulting photoconductive imaging member does not require an anti-curl layer.

EXAMPLE VI

Each of the photoconductive imaging members of Examples I–V is examined with a transmission optical microscope at 100× magnification. Spider shaped substrate cracking is visible in the photoconductive imaging member of Example II (Stabar S100). Extensive substrate cracking and bubble formation is visible in the photoconductive imaging member of Example III (Makrofol E substrate). The cracks observed in both the Stabar and Makrofol substrates extend to the titanium ground plane causing ground plane cracks which develop as print out defects in the copy. No substrate cracking or defect formation is noted in the imaging members of Example I (Melinex substrate), Example IV (Tedlar substrate) or Example V (Melinar substrate).

Photoreceptor imaging members of each of Examples I–V are evaluated for resistance to tension stress and heat. Each photoconductive imaging member is prepared according to the respective Example except that a 1.2 pound per inch width linear tension is applied to each member immediately after solution application of the charge transport layer.

Thereafter each member is dried at 115° C. for 5 minutes to evaluate the effect of actual production conditions. Dimensional increase (permanent deformation) is measured with the results as shown in Table III.

TABLE III

| EXAMPLE | SUBSTRATE TYPE | Tg(°C.) | DIMENSIONAL INCREASE(%) |
|---|---|---|---|
| I | MELINEX 442 | 125 | 0.12 |
| II | STABAR S100 | 225 | 0.01 |
| III | MAKROFOL | 158 | 0.08 |
| IV | TEDLAR | 32 | 1.34 |
| V | MELINAR | 71 | 1.16 |

These results indicate that the Tg of a supporting substrate has significant effect on the dimensional stability for photoconductive imaging member application. The photoconductive imaging member fabricated using the low Tg substrate such as Tedlar or Melinar gives the worst linear dimensional increase (the amount of sample length increase, expressed in percent, before and after completion of charge transport layer solution coating and sample tension heat/drying steps) under production simulation conditions.

EXAMPLE VII

Imaging members of Examples I and IV are evaluated for member creep under actual Xerographic machine functioning conditions. The photoconductive imaging members of Example I (having a Melinex 442 substrate) and Example IV (having a Tedlar substrate) are mechanically evaluated for extent of imaging member creep at an applied 1 pound per inch width tension (belt tension) at a temperature condition of 50° C. (machine on temperature). The experimental creep measurement is carried out following the methodology described in, "Tensile Creep Instrument for Thin Films", Modern Plastics, March 1977, pages 84–85. Creep results show that when testing is carried out at a temperature (50° C.) exceeding the Tg of the Tedlar substrate (32° C.), the imaging member exhibits significant creep elongation. An elevated temperature of 50° C. has relatively little effect on the creep behavior of the imaging member of Example I.

EXAMPLE VIII

The procedure of Example II is repeated to prepare a photoconductive imaging member, except that toluene and 4,4'-cyclohexylidene diphenyl polycarbonate are used in the charge transport layer coating solution in place of methylene chloride and Makrolon. The Stabar substrate is insoluble in toluene. The resulting imaging member is curl-free. The imaging member is examined with the transmission optical microscope at 100× magnification. No substrate cracking is noted.

EXAMPLE IX

The procedure of Example I is followed to prepare a photoconductive imaging member such that a 4 mil extrusion blown nylon substrate (Zytel 330 available from E. I. du Pont Co.) is used for the substrate material in place of the polyethylene terephthalate (Melinex 442). The Zytel support substrate has a Tg of about 120° and a linear thermal contraction coefficient of $6.2\times10^{-5}$/°C. The linear thermal contraction coefficient of the Zytel 330 is closely matched to the value of the coated charge transport layer. The resulting fabricated photoconductive imaging member is flat and does not require an anti-curl layer. The Zytel substrate is insoluble in methylene chloride and is not susceptible to solvent attack. No substrate cracking is evident when the imaging member is examined with the transmission optical microscope at 100× magnification.

While the invention has been described with particular reference to preferred embodiments, the invention is not intended to be limited to the specific examples given, and other embodiments and modifications can be made by those skilled in the art without departing from the spirit and scope of the invention.

What is claimed is:

1. An electrostatographic imaging member comprising a substrate and a charge transport layer applied by solution coating in methylene chloride; said substrate being comprised of a polymer selected from the group consisting of polyamide/nylons, polycarbonate/polybutylene terephthalate alloys, polyphthalamides, polyester liquid crystals, phenolic polymers and diallyl phthalates, said polymer insoluble in the methylene chloride and having a $T_g$ of at least 90° C. and a linear thermal contraction coefficient within about plus or minus $2\times10^{-5}$/°C. of the thermal contraction coefficient of said charge transport layer.

2. The electrostatographic imaging member of claim 1, wherein said member is an electrophotographic imaging member.

3. The electrostatographic imaging member of claim 2, wherein said polymer has a $T_g$ of at least 110° C.

4. The electrostatographic imaging member of claim 2, wherein said substrate has a thickness of between about 50 micrometers and about 200 micrometers and said charge transport layer comprises polycarbonate and has a thickness of between 10 micrometers and about 50 micrometers.

5. The electrostatographic imaging member of claim 2, wherein said substrate has a thickness of between about 65 micrometers and about 150 micrometers and said charge transport layer comprises polycarbonate and has a thickness of between about 20 micrometers and about 35 micrometers.

6. The electrostatographic imaging member of claim 2, wherein said substrate has a thickness of between about 75 micrometers and about 125 micrometers and said charge transport layer comprises polycarbonate and has a thickness of between about 23 micrometers and about 31 micrometers.

7. The electrostatographic imaging member of claim 2, wherein the linear thermal contraction coefficient of said substrate is within about $\pm2\times10^{-5}$/°C. , in the temperature range of between about 0° C. and the Tg of the substrate, of the linear thermal contraction coefficient of said charge transport layer.

8. The electrostatographic imaging member of claim 2, wherein the linear thermal contraction coefficient of said substrate is within about $\pm1\times10^{-5}$/°C. , in the temperature range of between about 0° C. and the Tg of the substrate, of the linear thermal contraction coefficient of said charge transport layer.

9. The electrostatographic imaging member of claim 2, wherein the linear thermal contraction coefficient of said substrate is within about $\pm0.5\times10^{-5}$/°C. , in the temperature range of between about 0° C. and the Tg of the substrate, of the linear thermal contraction coefficient of said charge transport layer.

10. The electrostatographic imaging member of claim 2, wherein the linear thermal contraction coefficients of said substrate and said charge transport layer are between about $5.6\times10^{-5}$/°C. and $7.5\times10^{-5}$/°C.

11. The electrostatographic imaging member of claim 2, which is free of an anti-curl layer.

12. The electrostatographic imaging member of claim 1, wherein said substrate is a gamma ray irradiated substrate.

13. The electrostatographic imaging member of claim 1, wherein said substrate comprises nylon.

14. An electrostatographic imaging member comprising a substrate and a charge transport layer applied by solution coating in methylene chloride; said substrate being comprised of a polymer subjected to gamma ray irradiation to provide a form insoluble in said methylene chloride and having a $T_g$ of at least 90° C. and a linear thermal contraction coefficient within about $\pm 2\times 10^{-5}$/°C. of the thermal contraction coefficient of said charge transport layer.

15. The electrostatographic imaging member of claim 14, wherein said form has a $T_g$ of at least 110° C.

16. The electrostatographic imaging member of claim 14, wherein the linear thermal contraction coefficient of said substrate is within about $\pm 1\times 10^{-5}$/°C. , in the temperature range of between about 0° C. and the $T_g$ of the substrate, of the linear thermal contraction coefficient of said charge transport layer.

17. The electrostatographic imaging member of claim 14, wherein the linear thermal contraction coefficients of said substrate and said charge transport layer are between about $5.6\times 10^{-5}$/°C. and $7.5\times 10^{-5}$/°C.

18. The electrostatographic imaging member of claim 14, wherein said substrate is comprised of a polymer selected from the group consisting of polysulfone, polyarylsulfone, polyacrylate, acrylic, polyvinylchloride, polyphenylene ether, polyphenylene oxide, acrylonitrile, butadiene styrene, bisphenol A polycarbonate, polyethersulfone, polystyrene and acrylonitrile.

* * * * *